US006589124B1

(12) United States Patent
Maruoka et al.

(10) Patent No.: US 6,589,124 B1
(45) **Date of Patent: *Jul. 8, 2003**

(54) HOLLOW GOLF BALL

(75) Inventors: Kiyoto Maruoka, Kobe (JP); Akihiro Nakahara, Ibaraki (JP); Kazuo Hochi, Amagasaki (JP)

(73) Assignee: Sumitomo Rubber Industries, Ltd., Hyogo-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/181,814

(22) Filed: Oct. 29, 1998

(30) Foreign Application Priority Data

Oct. 30, 1997 (JP) ..... 9-298596
Jul. 21, 1998 (JP) ..... 10-204910

(51) Int. Cl.[7] ..... A63B 37/06
(52) U.S. Cl. ..... 473/373; 473/375; 473/377
(58) Field of Search ..... 473/358, 369, 473/375, 352

(56) References Cited

U.S. PATENT DOCUMENTS 5,150,906 A * 9/1992 Molitor et al. ..... 473/375

* cited by examiner

*Primary Examiner*—William M. Pierce
(74) *Attorney, Agent, or Firm*—Birch, Stewart, Kolasch & Birch, LLP

(57) ABSTRACT

The present invention provides a hollow golf ball having good shot feel at the time of hitting by making impact force small, while keeping excellent flight performance. Improved shot feel at the time of hitting by improving an impact absorption, while keeping excellent flight performance. The present invention relates to a hollow golf ball comprising:

a hollow core composed of a hollow portion and one or more hollow core outer layers formed from a core composition comprising rubber component, resin component or the mixture thereof, and a cover formed on the hollow core, wherein, when a secondary natural frequency of the hollow golf ball is expressed as X and a deformation amount, when applying from an initial load of 10 kgf to a final load of 130 kgf on the hollow golf ball, is expressed as Y, a difference of X−Y is within the range of 0.1 to 1.5.

12 Claims, 6 Drawing Sheets

HOLLOW GOLF BALL

FIELD OF THE INVENTION

The present invention relates to a hollow golf ball. More particularly, it relates to a hollow golf ball having good shot feel at the time of hitting by making the impact force small, while maintaining excellent flight performance.

BACKGROUND OF THE INVENTION

Hitherto, there have been mainly produced two types of golf balls. The one is a solid golf ball, such as a two-piece golf ball or three-piece golf ball, and the other is a thread wound golf ball. The solid golf ball, when compared with the thread wound golf ball, has better durability and better flight performance because of a larger initial velocity at the time of hitting and longer flight distance. Therefore, the solid golf ball is generally approved or employed by many golfers, mainly amateur golfers. With regard to enhancement of the flight distance, the development of the golf ball is mainly directed toward solid golf balls rather than thread wound golf balls.

On the other hand, the solid golf ball exhibits a hard and poor shot feel at the time of hitting. It has been known that the flight distance is largely affected by rebound characteristics in the solid golf ball. Recently, in order to improve the shot feel of the solid golf ball, it has been attempted to soften the core of the solid golf ball to reduce the hardness of the golf ball. However, there is the drawback that the rebound characteristics of the golf ball are degraded and the flight performance is reduced, because of the softening of the core.

In order to extend the flight distance of golf balls, it is very important that the rebound characteristics of the golf ball are enhanced. The enhanced rebound characteristics may preferably be obtained by reducing the deformation amount of the golf ball. However, the reduced deformation amount of the golf ball adversely hardens the golf ball and deteriorates the shot feel at the time of hitting. On the other hand, when the golf ball is made soft and its deformation amount is large, the shot feel at the time of hitting is improved, but the rebound characteristics are reduced and the flight performance is reduced. Therefore, it is very difficult to improve both flight performance and shot feel of the conventional solid golf ball.

OBJECTS OF THE INVENTION

A main object of the present invention is to provide a hollow golf ball having good shot feel at the time of hitting by making the impact force small, while maintaining excellent flight performance.

In order to solve the problem, the present inventors have proposed to provide a hollow golf ball having good shot feel at the time of hitting, while maintaining excellent flight performance, by employing a hollow core composed of a hollow portion and a hollow core outer layer which enhances the moment of inertia of the resulting golf ball.

Retention of the spin amount of the golf ball can vary depending on the moment of inertia of the golf ball as well as the shape of the dimples. In general, when the moment of a inertia of golf ball is charge, it is difficult to apply spin on the golf ball, and the spin amount is easily maintained. That is, it is difficult to apply spin on the golf ball having a large moment of inertia at the time of hitting by a driver, and thus the flight distance is extended because the golf ball does not create a blown-up trajectory. As is further explained in detail, when a golf ball is hit by a golf club, the lifting power acts on the golf ball, and the partial force of the lifting power in the horizontal direction acts positively to the ball flight direction after the golf ball passes the highest point of the flight curve. That is, it is difficult to apply spin on the golf ball having a larger moment of inertia at the time of hitting by a driver. The lower the spin amount, the smaller the lifting power, and the partial force in the direction of backing the golf ball is small to extend flight distance, from immediately after hitting the golf ball by a driver to the arrival at the highest point of the flight curve of the golf ball. The higher the spin amount (the larger the retention of spin amount), the larger the lifting power acts on the golf ball, and the partial force of the lifting power in the flight direction is larger for extending the flight distance, after the golf ball passes the highest point of the flight curve. The larger the moment of inertia, the smaller the descending angle of the golf ball. Thus the a distance from the point when the golf first drops to the ground to the stop point finally reached by the golf ball is extended. Therefore, the larger the moment of inertia of the golf ball, the longer the flight distance of the golf ball, aerodynamically. With approach shots, when the moment of inertia of the golf ball is larger, it is easy to stop the golf ball because of easily retaining the spin amount.

The present inventors have further studied the hollow golf ball for shot feel at the time of hitting and rebound characteristics in detail, and then different results from conventional solid golf balls have been obtained. That is, in the case of the hollow golf ball, golf balls have the same deformation amount but may show different rebound characteristics (flight distance) and impact force (shot feel). The reason for this is believed to be as follows. The hollow golf ball has a hollow portion, thus a hollow core may deform also in a direction of flexure. Therefore, the deformation amount of the hollow golf ball can be determined depending on the compressive modulus and flexural modulus of the core composition, and the diameter of the hollow portion. The hollow golf ball shows different behavior from the solid golf ball of which the deformation amount can be only determined by the compressive modulus of the core composition.

In order to improve both rebound characteristics and shot feel by using the specific characteristics of the hollow golf balls as explained above, the present inventors have taken note of the deformation amount and natural frequency of the golf ball. The deformation amount has been considered to effect both the rebound characteristics and shot feel at time of hitting. The natural frequency is estimated to effect the impact force, that is, the reactive force given to a golf club upon hitting a golf ball. As a result, the inventors have found that a hollow golf ball having superiority in both rebound characteristics and shot feel can be obtained by adjusting the difference between the deformation amount (Y mm) and the secondary natural frequency, (X kHz) within a certain range. The deformation amount is determined from applying from an initial load of 10 kgf to a final load of 130 kgf on the hollow golf ball.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
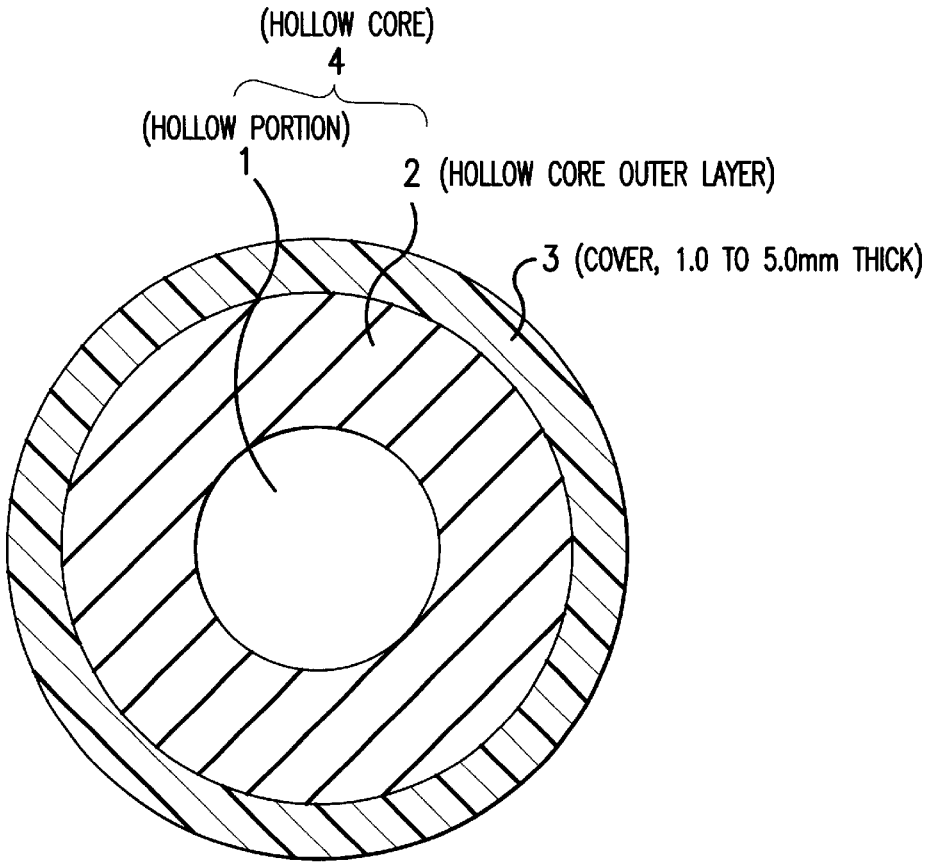
FIG. 1 is a schematic cross section illustrating one embodiment of the golf ball of the present invention.

The present invention provides a hollow golf ball which comprises:

a hollow core composed of a hollow portion and one or more hollow core outer layers formed from a core composition comprising a rubber component, resin component or the mixture thereof, and a cover formed on the hollow core, wherein, when a secondary natural frequency of the hollow golf ball is expressed as X and a deformation amount as determined from applying an initial load of 10 kgf to a final load of 130 kgf on the hollow golf ball, is expressed as Y, the difference of X−Y is within the range of 0.1 to 1.5.

It is required that the hollow golf ball of the present invention has the difference (X−Y) of 0.1 to 1.5, preferably 0.6 to 1.1, when the secondary natural frequency of the hollow golf ball is expressed as X (kHz). The deformation amount of the hollow golf ball when applying from an initial load of 10 kgf to a final load of 130 kgf on the golf ball, is expressed as Y (mm). When the (X−Y) value is larger than 1.5, the impact force is too large and thus the shot feel is very poor. On the other hand, when the (X−Y) value is smaller than 0.1, rebound characteristics are largely degraded, and thus the flight distance is very short.

The term "natural frequency" as used herein refers to a frequency that an element itself inherently has when it is freely vibrated without external effect. The number of the natural frequency which exists corresponds to the degree of freedom in the system. It is called, for example, primary natural frequency, secondary natural frequency and the like in accordance with increment of frequency. The natural frequency is naturally determined by physical properties, shape and the like of the element. Particularly, the secondary natural frequency among the above natural frequency is closely connected with shot feel of golf balls. A method of measuring the natural frequency is as follow. A golf ball is mounted on a vibrator and continuously vibrated from 0 to 10 kHz and then the frequency of the golf ball is measured from an upper side of the golf ball using radar a laser beam. The acceleration related to the frequency value of the vibrator as the input and an acceleration related to the frequency value of the golf ball obtained from the radar as an output are operated using a frequency analyzer to obtain natural frequencies. The secondary natural frequency value is the second one from the minimum value in the value of natural frequencies. The golf ball of the present invention has a secondary natural frequency of 2 to 5 kHz, preferably 3.3 to 4 kHz. When the secondary natural frequency is larger than 5 kHz, the golf ball is too hard, thus the shot feel is poor. On the other hand, when the secondary natural frequency is smaller than 2 kHz, the golf ball is too soft, and thus the rebound characteristics are degraded.

The golf ball of the present invention has a deformation amount of 2.0 to 4.0 mm, preferably 2.5 to 3.2 mm, when applying from an initial load of 10 kgf to a final load of 130 kgf on the golf ball. When the deformation amount is larger than 4.0 mm, the golf ball is too soft, and thus the rebound characteristics are degraded. On the other hand, when the deformation amount is smaller than 2.0 mm, the golf ball is too hard, thus shot feel is poor.

DETAILED DESCRIPTION OF THE INVENTION

The present invention will be described in detail hereinafter. FIG. 1 is a schematic cross section illustrating one embodiment of the hollow golf ball of the present invention. The golf ball of the present invention comprises a hollow core 4 which is composed of a hollow portion 1 and one or more hollow core outer layers 2, and a cover 3 formed on the core. When the diameter of the hollow portion 1 is larger, the deformation amount is larger and the secondary natural frequency is smaller, which improves the shot feel, but the rebound characteristics are degraded. On the other hand, when the diameter of the hollow portion is smaller, the deformation amount is smaller and then the secondary natural frequency is larger, which degrades the shot feel, but the rebound characteristics are improved. Therefore, the diameter of the hollow portion is preferably within the range of 5 to 25 mm, more preferably 8 to 22 mm, most preferably 10 to 22 mm, in order to optimize the rebound characteristics and the shot feel.

The hollow core outer layer 2 is formed from a core composition containing a rubber component, a resin component or the mixture thereof, and may have a single layer structure or multi-layer structure which has two or a more layers. When the hollow core outer layer 2 has the multi-layer structure, the hollow outer layers may be formed from the same material or different material. It is preferable that the hollow core outer layer 2 is formed from a core composition containing a rubber component in order to improve both rebound characteristics and shot feel.

When the hollow core outer layer 2 of the present invention is composed of a core composition containing a rubber component, it is obtained by vulcanizing or press-molding the rubber composition which can be typically used for the core of a golf ball. The rubber composition typically comprises a base rubber, a metal salt of an unsaturated carboxylic acid, an organic peroxide, a filler and the like.

The base rubber may be natural rubber and/or synthetic rubber which has been conventionally used for solid golf balls. Preferred is high cis-polybutadiene rubber containing a cis-1, 4 bond of not less than 40%, preferably not less than 80%. The polybutadiene rubber may be mixed with natural rubber, polyisoprene rubber, styrene-butadiene rubber, ethylene-propylene-diene rubber (EPDM), and the like.

The metal salt of the unsaturated carboxylic acid, which acts as a co-crosslinking agent, includes monovalent or divalent metal salts, such.as zinc or magnesium salts of α, β-unsaturated carboxylic acids having 3 to 8 carbon atoms (e.g. acrylic acid, methacrylic acid, etc.). A preferred co-crosslinking agent is zinc acrylate because it imparts high rebound characteristics to the resulting golf ball. The amount of the metal salt of the unsaturated carboxylic acid in the rubber composition is preferably 25 to 55 parts by weight, based on 100 parts by weight of the base rubber. When the amount of the metal salt of the unsaturated carboxylic acid is larger than 55 parts by weight, the core is too hard and thus the shot feel is poor. On the other hand, when the amount of the metal salt of the unsaturated carboxylic acid is smaller than 25 parts by weight, the core is soft. Therefore, the rebound characteristics are degraded which reduces flight distance.

The organic peroxide, which acts as a crosslinking agent or a hardener, includes, for example, dicumyl peroxide, t-butyl peroxide and the like. Preferred organic peroxide is dicumyl peroxide. An amount of the organic peroxide may preferably be from 0.1 to 2.0 parts by weight, based on 100 parts by weight of the base rubber. When the amount of the organic peroxide is smaller than 0.1 parts by weight, the core is too soft. Therefore, rebound characteristics are degraded to reduce flight distance. On the other hand, when the amount of the organic peroxide is larger than 2.0 parts by weight, the core is too hard, thus shot feel is poor.

The filler, which can be typically used for the core of golf ball, includes for example, an inorganic filler (such as zinc oxide, barium sulfate, calcium carbonate and the like), high specific gravity metal powder (such as tungsten powder, molybdenum powder, and the like), and the mixture thereof. Since the hollow core employed in the present invention has a lighter weight than a conventional solid core because of the presence of the hollow portion, a combination of the inorganic filler and the high specific gravity metal powder is preferable. The amount of the filler is preferably from 10 to 120 parts by weight, based on 100 parts by weight of the base rubber. When the amount of the filler is smaller than 10 parts by weight, the technical effects accomplished by using the filler for the hollow core are not obtained. On the other hand, when the amount of the filler is larger than 120 parts by weight, the weight ratio of the rubber component in the core is too low. Therefore, the rebound characteristics of the resulting golf ball are degraded.

When the hollow core outer layer 2 used in the present invention has a multi-layer structure which has two or more layers, the hollow core outer layer preferably has at least one layer formed from the rubber composition. It is preferable to place the layer formed from the rubber composition as the external layer of the hollow core in order to improve both the rebound characteristics and shot feel. The hollow core outer layer 2 has a thickness of not less than 5 mm, preferably not less than 7 mm in order to improve both the rebound characteristics and shot feel.

The hollow core outer layer 2 of the present invention is obtained by a method which comprises the steps of forming the rubber composition for the hollow core into a semi-vulcanized semi-spherical half-shell having a concave portion, bonding the two semi-vulcanized half-shells together and completely vulcanizing the composite. The term "semi-vulcanized" as used herein refers to a state that a rubber composition is vulcanized but vulcanization stops before completely finishing the crosslinking reaction. The semi-vulcanized article can keep its molded shape, and can be further vulcanized to complete the crosslinking reaction when heating again. The semi-vulcanization may be preferably adjusted to a condition that vulcanizing time is quarter to half of the condition of complete vulcanization, preferably about one third of the condition of complete vulcanization. When complete vulcanization is conducted, for example, at 150° C. for 30 minutes, a state of semi-vulcanization can be obtained by vulcanizing at 150° C. for about 10 minutes. In the case of the hollow core 4 of the present invention, since complete vulcanization is typically conducted at 150 to 170° C. for 10 to 30 minutes, a state of semi-vulcanization may be obtained by stopping the vulcanization at the same temperature for about one third of the vulcanizing time.

When the hollow core outer layer 2 is formed from a core composition containing a resin component, the hollow core outer layer may be obtained by forming a half-shell by a typical molding method (such as injection-mold and the like), and then bonding the two half-shells with an adhesive. Examples of the resin components, which are not limited to a typical thermoplastic resin that can be injection-molded, include a thermoplastic elastomer which is composed of a hard segment and soft a segment, and mixture thereof. The thermoplastic resin has a melting point of not less than 150° C., preferably not less than 160° C., more preferably not less than 170° C. The use of the resin component having a higher melting point can prevent the hollow core from easily deforming when vulcanizing or press-molding a core rubber layer on a hollow center. Examples of the thermoplastic resins include, for example, polyethylene, polypropylene, polystyrene, polyvinyl chloride, polymethyl methacrylate, polyacetal, polyamide, polyoxymethylene, polycarbonate, polyester, polyphenylene oxide, polysulfone, polyimide, etc. or combinations thereof. Examples of the thermoplastic elastomers include a polyester-type thermoplastic elastomer, an urethane-type thermoplastic elastomer, a styrene-type thermoplastic elastomer, a polyamide-type thermoplastic elastomer, etc. or combinations thereof. Preferred is a polyester-type thermoplastic elastomer or an urethane-type thermoplastic elastomer, because it can impart high rebound characteristics to the resulting golf ball. The core composition may contain fillers for adjusting specific gravity, rubber microparticles for imparting flexibility to the resulting golf ball, crosslinking agent for the rubber microparticles, etc., in addition to the resin component. The thermoplastic resin (including the thermoplastic elastomer) preferably has a Shore D hardness of 30 to 80. When the Shore D hardness is smaller than 30, the rebound characteristics are degraded. On the other hand, when the Shore D hardness is larger than 80, the shot feel is poor.

When the internal pressure of the hollow core 4 is higher than atmospheric pressure, or lower than atmospheric pressure, it is difficult to produce it, and the cost of production is high, and therefore it is not very preferable. Particularly when the internal pressure of the hollow core 4 is lower than atmospheric pressure, there is the problem that the hollow core readily deforms at the step of covering it with the cover and the like. On the other hand, when the internal pressure of the hollow core 4 is much higher than atmospheric pressure, the effect of improving the shot feel by the presence of the hollow portion is reduced. For the above reason, it is preferable that the internal pressure of the hollow core 4 in the resulting golf ball is approximately atmospheric pressure to 1 $kgf/cm^2$, preferably approximately atmospheric pressure to 1.5 $kgf/cm^2$, more preferably approximately atmospheric pressure. The method of encapsulating a gas in the core at atmospheric pressure shows the most excellent production efficiency, and therefore is preferable. The internal pressure of the hollow portion of the resulting golf ball of the Examples and Comparative Examples is approximately atmospheric pressure, because the hollow golf ball is produced by encapsulating air in the hollow portion at atmospheric pressure. In this context, the wording "approximately atmospheric pressure" corresponds to a change of internal pressure occurring by the difference between the temperature of the encapsulating gas and the temperature of the resulting golf ball (ordinary temperature). The temperature of the encapsulating gas can be controlled by controlling temperature of gas, the ambient temperature of the molding room or the temperature of the molding component. The production efficiency and cost of production are improved by adjusting the temperature to not more than 100° C., preferably not more than 50° C., considering the controllable temperature range. When a temperature change is 100° C., the internal pressure change is 40%. When a temperature change is 50° C., the internal pressure change is 20%. It is required to encapsulate air at a much higher temperature or at a much lower temperature in order to impart a larger temperature difference, thereby the production efficiency is degraded and cost of production is high. For the above reason, the internal pressure of the resulting golf ball at ordinary temperature is within the range of atmospheric pressure ±40%, preferably atmospheric pressure ±20%.

The cover 3 is then covered on the hollow core 4 obtained as described above. The cover may be formed from thermoplastic resins which have been conventionally used for forming the cover of solid golf balls, such as an ionomer resin, balata and the like. Preferred is an ionomer resin. The cover used in the present invention may optionally contain other resins in addition to the ionomer resin, such as a polyamide resin, a polyester resin and the like. The cover used in the present invention may optionally contain fillers (such as barium sulfate, etc.), pigments (such as titanium dioxide, etc.), and the other additives such as an antioxidant, a UV absorber, a photostabilizer and a fluorescent agent or a fluorescent brightener, etc., in addition to the resin component, as long as the addition of the additives does not deteriorate the desired performance of the golf ball cover. The amount of the pigment is preferably from 0.1 to 0.5 parts by weight based on 100 parts by weight of the cover resin component.

The cover used in the present invention is formed by a conventional method for forming golf ball cover well known in the art, such as injection molding, press-molding and the like. The cover may have a thickness of 1.0 to 5.0 mm, preferably 2.0 to 3.5 mm. At the time of molding the cover, many depressions called "dimples" may be typically formed on the surface of the golf ball. Furthermore, a paint finishing or marking stamp may be optionally provided after molding the cover.

EXAMPLES

The following Examples and Comparative Examples further illustrate the present invention in detail but are not to be construed as limiting the scope of the present invention to their details.

Examples 1 to 5 and Comparative Examples 1, 2 and 5

Production of Hollow Core

Figure 2:
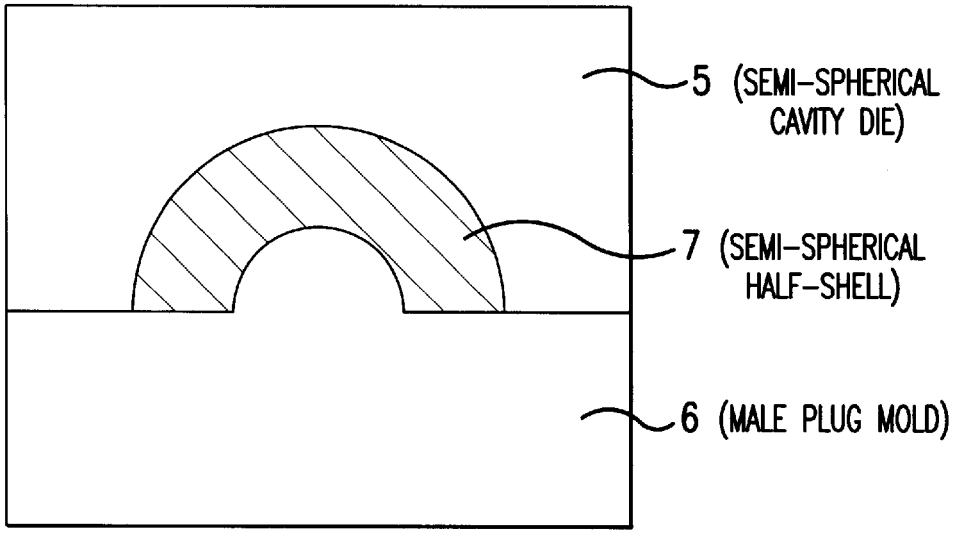
FIG. 2 is a schematic cross section illustrating one embodiment of a mold for molding a hollow core outer layer of the golf ball of the present invention.

A semi-spherical half-shell 7 was formed by mixing the following core rubber compositions shown in Tables 1 and 2, and press-molding the mixture at 165° C. for 20 minutes using a semi-spherical cavity die 5 and a male plug mold 6 having a semi-spherical convex plug shown in FIG. 2. The same rubber composition as the semi-spherical half-shell was cut in a thickness of 0.5 mm, and put between the adhesive surfaces of two semi-spherical half-shells for a hollow core. The two semi-spherical half-shells were vulcanized and press-molded at 165° C. for 20 minutes in two semi-spherical cavity dies to obtain a hollow core having a diameter of 38.4 mm.

TABLE 1

| | (parts by weight) | | | | | | |
|---|---|---|---|---|---|---|---|
| Example No. | 1 | 2 | 3 | 4 | 5 | 6 | 7 |
| BR-11 *1 | 100 | 100 | 100 | 100 | 100 | 100 | 100 |
| Zinc acrylate | 36 | 36 | 36 | 36 | 36 | 36 | 36 |
| Zinc oxide *2 | 35 | 35 | 35 | 24 | 72 | 35 | 35 |
| Dicumyl peroxide | 0.4 | 0.8 | 1.3 | 0.3 | 1.6 | 1.3 | 1.3 |

TABLE 2

| Comparative | (parts by weight) | | | | |
|---|---|---|---|---|---|
| Example No. | 1 | 2 | 3 | 4 | 5 |
| BR-11 *1 | 100 | 100 | 100 | 100 | 100 |
| Zinc acrylate | 36 | 36 | 36 | 36 | 36 |
| Zinc oxide *2 | 35 | 35 | 23 | 23 | 72 |
| Dicumyl peroxide | 0.2 | 1.7 | 0.8 | 1.5 | 0.2 |

*1: Polybutadiene (trade name "BR-11") available from JSR Co., Ltd., content of cis-1, 4 bond = 96%
*2: Zinc oxide (trade name "Aenka No.3") available from Toho Aen Co., Ltd.

Production of Hollow Golf Ball

The cover composition shown in Table 3 was covered on the hollow core obtained as described above in a thickness of 2.3 mm by injection molding, followed by painting the surface with two-component clear urethane paint to obtain a hollow golf ball. The diameter of the hollow portion, deformation amount, natural frequency, difference of the deformation amount from the natural frequency, coefficient of restitution, impact force, flight performance (carry, launch angle, initial spin amount and retention of spin amount) and shot feel of the resulting golf ball were measured or evaluated. The results are shown in Table 4 and Table 5. The test methods are described later.

TABLE 3

| Cover composition | Amount (parts by weight) |
|---|---|
| Hi-milan 1605 *3 | 100 |
| Titanium dioxide | 2 |

*3: Hi-milan 1605 (trade name), ethylene-methacrylic acid copolymer ionomer resin obtained by neutralizing with sodium ion, manufactured by Mitsui Du Pont Polychemical Co., Ltd.

Examples 6 and 7

Production of Hollow Center

A semi-spherical half-shell was formed by injection-molding the center resin described as follows, and the two half-shells welded together by the welding method described as follows to obtain a hollow center having a thickness of 2 mm and a outer diameter of 19 mm.

Center Resins

Example 6: thermoplastic polyester elastomer (Grilax EH700, available from Dainippon Ink & Chemical Inc., melting point: 202° C.)

Example 7: thermoplastic polyamide resin (3035U, available from Ube Kosan Co., Ltd., melting point: 180° C.)

Welding Method

Ultrasonic welding: The half-shells were welded using a ultrasonic plastic welder W-3161 manufactured by Brother industries Ltd., at a ultrasonic frequency of 20 kHz and contact pressure of 1.5 kg/cm$^2$.

Production of Hollow Core

A semi-spherical half-shell was formed by mixing the core rubber compositions shown in Table 1, and press-molding the mixture for 1 minute using a semi-spherical cavity die and a male plug mold having a semi-spherical convex plug shown in FIG. 2 preheated at 160° C. The resulting hollow center described above was put in the two half-shells after removing the male plug mold, and then the two half-shells were vulcanized and press-molded at 165° C. for 15 minutes in the mold for molding core shown in FIG. 3 to obtain a hollow core having a diameter of 38.4 mm.

Production of Hollow Golf Ball

The cover composition shown in Table 3 was covered on the hollow core obtained as described above in a thickness of 2.3 mm by injection molding, followed by painting the surface with two-component clear urethane paint to obtain a hollow golf ball as described in Examples 1 to 5 and Comparative Examples 1, 2 and 5. The diameter of the hollow portion, deformation amount, natural frequency, difference of the deformation amount from the natural frequency, coefficient of restitution, impact force, flight performance (carry, launch angle, initial spin amount and retention of spin amount) and shot feel of the resulting golf ball were measured or evaluated. The results are shown in Table 4. The test methods are described later.

Comparative Examples 3 and 4

Production of Solid Core

Figure 3:
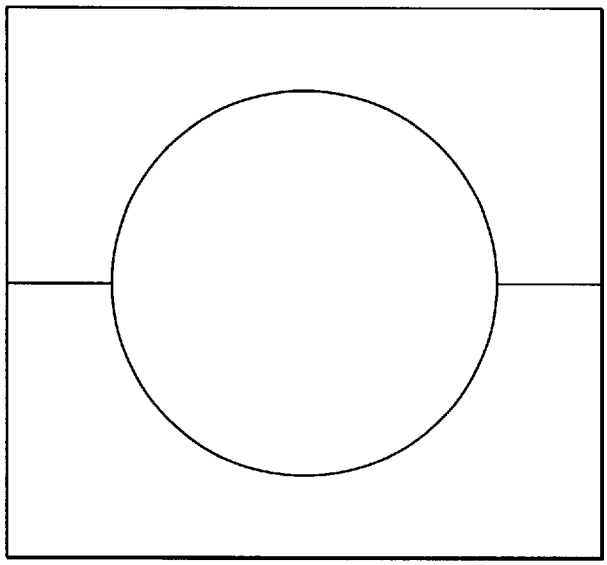
FIG. 3 is a schematic cross section illustrating one embodiment of a mold for molding a hollow core of a golf ball of the present invention.

A solid core was obtained by mixing the core rubber composition shown in Table 2 and vulcanizing or press-molding the mixture at 165° C. or 20 minutes using the mold for molding core shown in FIG. 3 to obtain a solid core having a diameter of 38.4 mm.

Production of Solid Golf Ball

The cover layer was formed, and the surface was painted to obtain a solid golf ball as described in Examples 1 to 5 and Comparative Examples 1, 2 and 5, except for using the solid core obtained as described above. The diameter of the hollow portion, deformation amount, natural frequency, difference of the deformation amount from the natural frequency, coefficient of restitution, impact force, flight performance (carry, launch angle, initial spin amount and retention of spin amount) and shot feel of the resulting golf ball were measured or evaluated. The results are shown in Table 5. The test methods are described as follows.

Test Method (1) Natural Frequency

Figure 5:
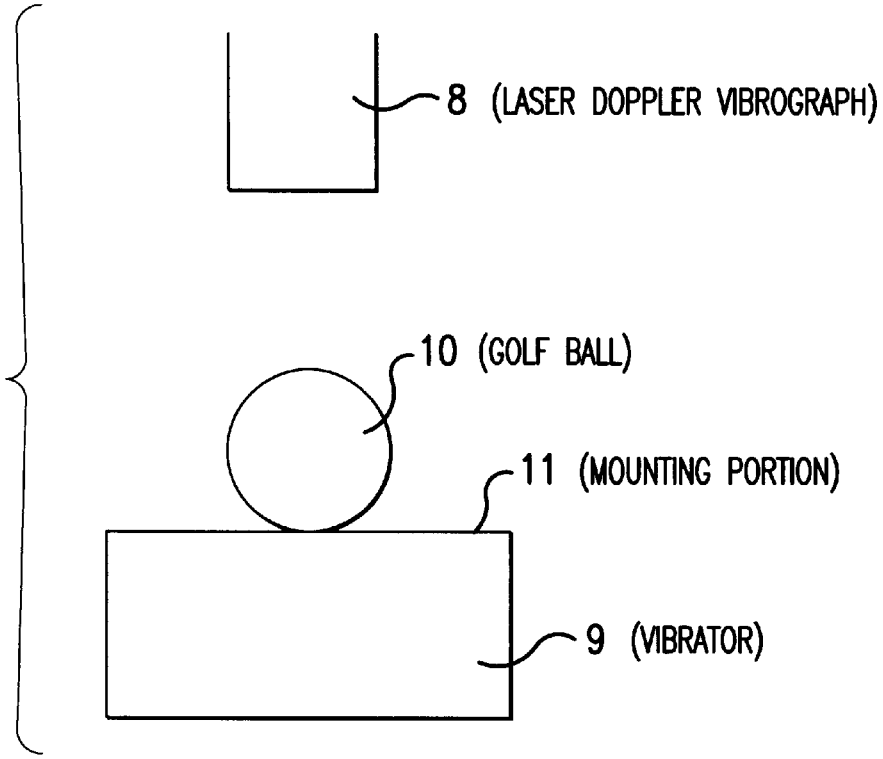
FIG. 5 is a drawing schematically showing a method of measuring natural frequency.
Figure 6:
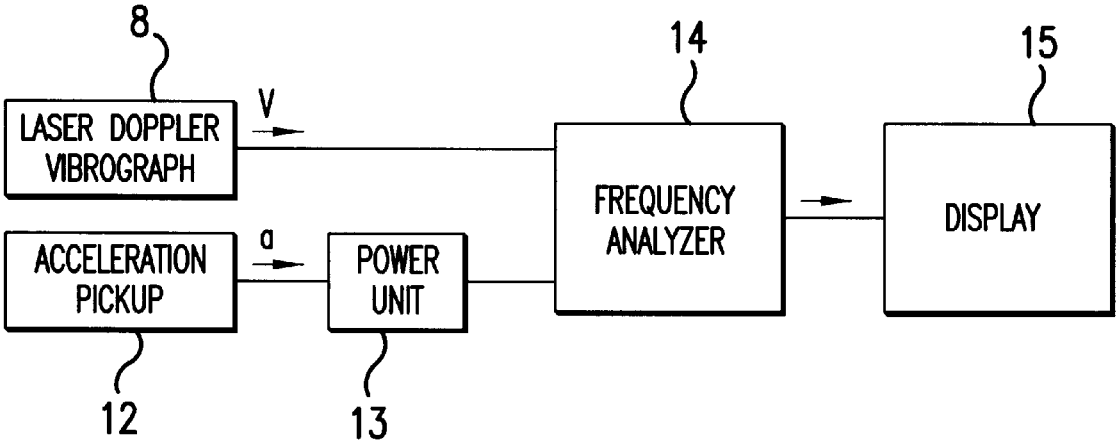
FIG. 6 is a flow chart illustrating the method of measuring natural frequency.
Figure 7:
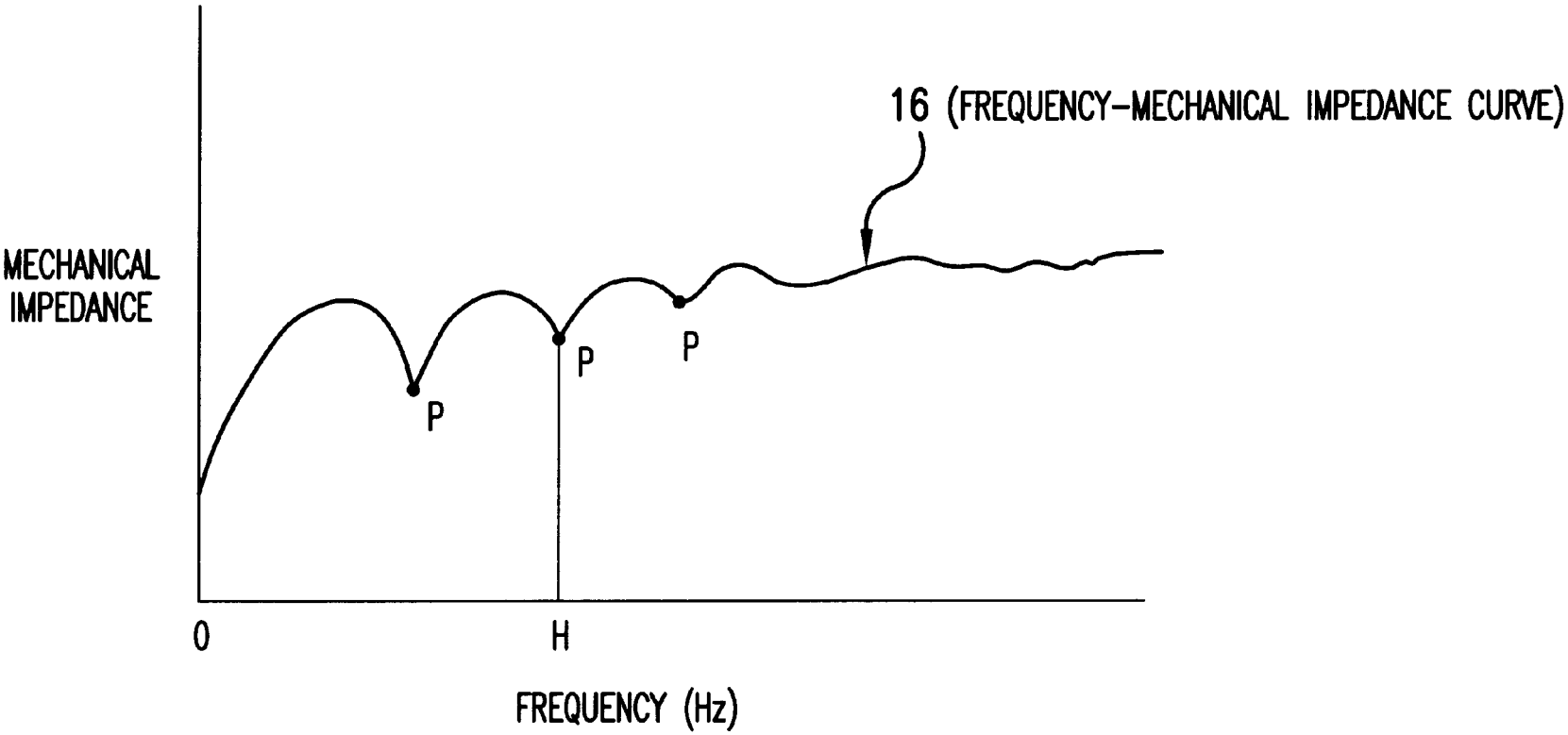
FIG. 7 is a drawing showing a frequency-mechanical impedance curve obtained by the method of measuring natural frequency.

After a golf ball 10 was mounted on a mounting portion 11 of a vibrator 9 (vibrator 513-A manufactured by Shinnippon Keiki, Co., Ltd.) having an area of 1 cm$^2$ and continuously vibrated from 0 to 10 kHz, the frequency of the golf ball was measured from an upper side of the golf ball in the vertical direction, using a radar with laser beam, i.e. a laser Doppler vibirograph 8 (Laser Doppler Vibrograph, Type 55L66/X66 manufactured by Dantec Co.) in non-contact manner as described in FIG. 5. As described in FIG. 6, for vibration of the vibrator 9, an "acceleration of vibrator" was measured by an acceleration pickup 12 attached the vibrator 9 (Acceleration Pickup 303A03 manufactured by PCB Co.) and put out, and the output was put in a frequency analyzer 14 (FTT analyzer (dynamic signal analyzer), Type 5420A manufactured by Yokogawa Hewlett Packard Co.) as an "acceleration a of vibrator 9" through a power unit 13 (Power Unit 480D06 manufactured by PCB Co.). For the vibration of the golf ball 10 , a "response velocity V of a golf ball" was measured by the laser Doppler vibrograph 8 and put out, and the output was put in the frequencyanalyzer 14. A calculation operation in a region of frequency can be conducted by using the frequency analyzer 14. Firstly, the "acceleration a of vibrator 9" was converted to "force F". The calculation operation of Z=F/V was conducted with the obtained "force F", i.e. "input F of vibrator" and "response velocity V golf ball", to obtain a mechanical impedance Z. A graph shown in FIG. 7 is obtained by displaying the mechanical impedance Z in a display 15 , wherein the axis of ordinates represents an absolute value of mechanical impedance, and the axis of abscissas represents frequency. In the graph, "frequency-mechanical impedance curve 16" is indicated. Out of minimum values P of mechanical impedance in "frequency-mechanical impedance curve 16", the frequency value H corresponding to the second minimum value of mechanical impedance in order of frequency is the frequency at the secondary minimum value of mechanical impedance. The frequency value H as used herein represents a secondary natural frequency. That is, a secondary minimum value of mechanical impedance obtained by vibrating the golf ball of which a portion is fixed using a vibrator is a secondary natural frequency. The mechanical impedance is a response ratio of a point to the other point when force acts on the point, and represented by the following formula:

$$Z=F/V$$

wherein Z represents a mechanical impedance, F represents an input, and V represents a response velocity. The mechanical impedance can be determined depending on physical properties or shape of the measured material.

(2) Deformation Amount

The compressive deformation amount of golf balls was determined by measuring a deformation amount when applying from an initial load of 10 kgf to a final load of 130 kgf on the golf ball.

(3) Coefficient of Restitution

A stainless steel cylinder having a weight of 200 g was struck at a speed of 40 m/sec against a golf ball, and the velocity of the cylinder and the golf ball before and after the strike were measured. The coefficient of restitution of the golf ball was determined by calculating from the velocity and the weight of both the cylinder and the golf ball. The larger the coefficient of restitution is, the more excellent the rebound characteristics are.

(4) Impact Force

After a driver (a No.1 wood club, trade name Dunlop DP-10, manufactured by Sumitomo Rubber Industries, Ltd.) was mounted to a swing robot manufactured by True Temper Co. and the golf ball was hit at a head speed of 40 m/second, the acceleration in the opposite direction of moving the golf club on impact was measured by an acceleration pickup attached to the side metal portion of the golf club head on an opposite side of a striking point with the ball in parallel with a surface of a face. The impact force was determined by changing the maximum value of the acceleration into force as represented by the following formula:

$$F=M\times W$$

wherein F represents, a force, M represents the maximum acceleration at the time of hitting, and W represents the weight of club head, which is 210 g.

(5) Flight Distance and Launch Angle

After a driver was mounted on a swing robot manufactured by True Temper Co. and the golf ball was hit at a head speed of 45 m/sec, carry as flight distance and launch angle were measured. Carry is a distance to the point firstly dropping the golf ball on the ground.

(6) Initial Spin Amount and Retention of Spin Amount

Figure 4:
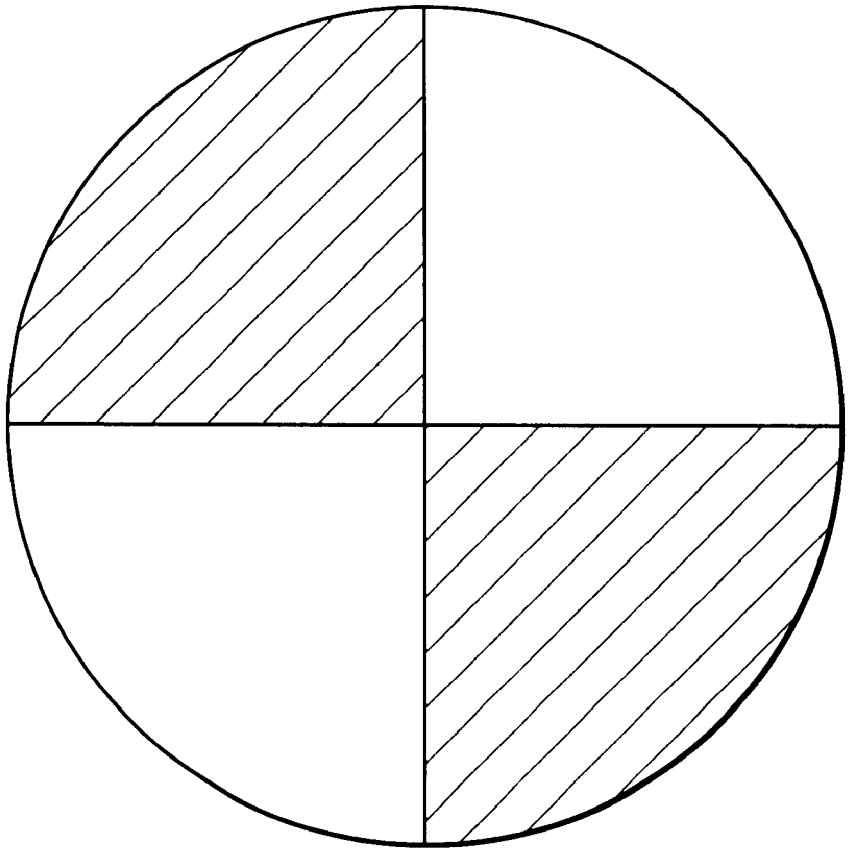
FIG. 4 is a schematic view illustrating a golf ball utilized for measuring the spin amount, which is painted with separate colors of black and white.

After a driver was mounted on a swing robot manufactured by True Temper Co. and a golf ball was hit at a head speed of 45 m/sec, an initial spin amount of the hit golf ball at the time of launch, and an spin amount of the golf ball at 150 yards point during the flight were measured. Four divided sections of the surface of the golf ball were separately painted with black and white paint as shown in FIG. 4. At the 150 yards point, a lamp for shining the golf ball from below and a sensor for discriminating between black and white were set. A black and white timing axis waveshape when passing through the light was monitored by using an oscilloscope and a revolution per minute were determined from the waveshape.

(7) Shot Feel

The shot feel at the time of hitting of the golf ball was evaluated by 10 professional golfers according to a practical hitting test using a No.1 wood club (a driver). The evaluation criteria are as follows.

Evaluation Criteria

◎: Not less than 8out of 10 golfers felt that golf ball has good shot feel.

○: From 5 to 7 out of 10 golfers felt that golf ball has good shot feel.

Δ: From 2 to 4 out of 10 golfers felt that golf ball has good shot feel.

X: Not more than 1 golfers felt that golf ball has good shot feel.

Test Result

TABLE 4

| | Example No. | | | | | | |
|---|---|---|---|---|---|---|---|
| Test item | 1 | 2 | 3 | 4 | 5 | 6 | 7 |
| Diameter of hollow portion (mm) | 15 | 15 | 15 | 8 | 22 | 15 | 15 |
| Natural frequency X (kHz) | 3.4 | 3.5 | 4.0 | 3.9 | 3.3 | 3.6 | 3.7 |
| Deformation amount Y (mm) | 3.3 | 2.9 | 2.5 | 3.2 | 2.4 | 2.7 | 2.6 |
| X-Y | 0.1 | 0.6 | 1.5 | 0.7 | 0.9 | 0.9 | 1.1 |
| Coefficient of restitution | 0.769 | 0.775 | 0.782 | 0.780 | 0.781 | 0.780 | 0.780 |
| Impact force (kgf) | 1070 | 1080 | 1170 | 1110 | 1110 | 1120 | 1160 |
| Carry (yard) | 202 | 204 | 207 | 204 | 203 | 203 | 204 |
| Launch angle (°) | 10.9 | 10.3 | 10.1 | 10.2 | 11.0 | 10.0 | 10.0 |
| Initial spin amount (rpm) | 2480 | 2520 | 2650 | 2660 | 2490 | 2680 | 2690 |
| Retention of spin amount (%) | 94.2 | 94.3 | 94.0 | 90.3 | 96.6 | 94.7 | 94.8 |
| Shot feel | ◎ | ◎ | ○ | ◎ | ◎ | ◎ | ○ |

TABLE 5

| | Comparative Example No. | | | | |
|---|---|---|---|---|---|
| Test item | 1 | 2 | 3 | 4 | 5 |
| Diameter of hollow portion (mm) | 15 | 15 | 0 | 0 | 22 |
| Natural frequency X (kHz) | 3.4 | 3.9 | 3.7 | 4.2 | 3.1 |
| Deformation amount Y (mm) | 3.5 | 2.2 | 2.9 | 2.6 | 3.2 |
| X-Y | −0.1 | 1.7 | 0.8 | 1.6 | −0.1 |
| Coefficient of restitution | 0.740 | 0.784 | 0.771 | 0.785 | 0.756 |
| Impact force (kgf) | 1060 | 1290 | 1320 | 1390 | 1070 |
| Carry (yard) | 189 | 207 | 198 | 199 | 194 |
| Launch angle (°) | 11.1 | 10.0 | 9.7 | 9.5 | 10.5 |
| Initial spin amount (rpm) | 2390 | 2710 | 2850 | 2880 | 2410 |
| Retention of spin amount (%) | 93.9 | 94.1 | 88.0 | 88.3 | 94.2 |
| Shot feel | ◎ | Δ | X | X | ◎ |

Figure 8:
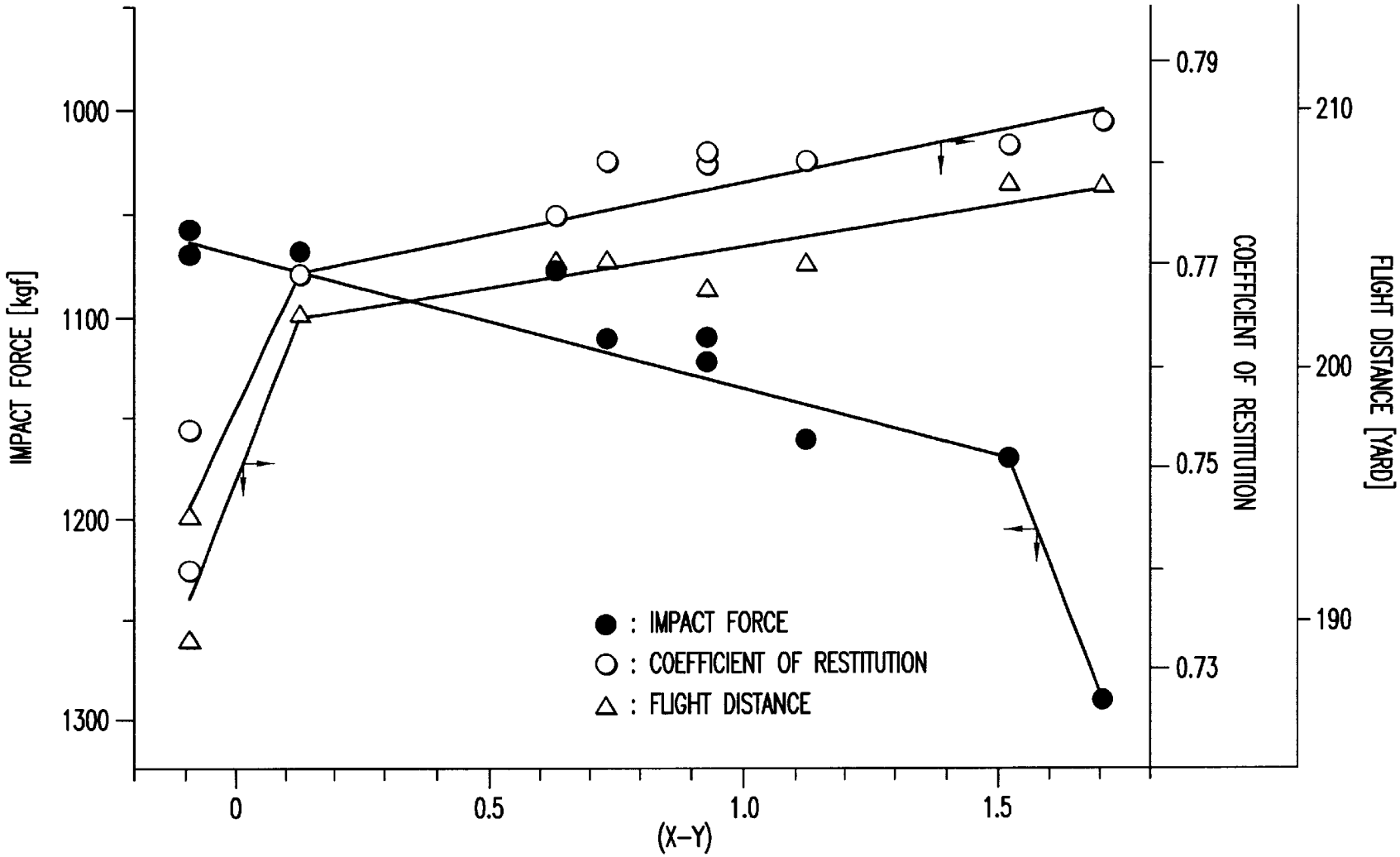
FIG. 8 is a graph showing the relationship of the difference (X−Y) with between the natural frequency X and the deformation amount Y with each of impact force, coefficient of restitution and flight distance.

The above results are shown in FIG. 8, which is a graph showing a relation of a difference (X−Y) of deformation amount Y and natural frequency X with each of impact force, coefficient of restitution and flight distance as the axes of ordinates.

As is apparent fromthe comparison of the physical properties of the golf balls of Examples 1 to 7 shown in Table 4 with those of the golf balls of Comparative Examples 1 to 5 shown in Tables 5, the golf balls of the present invention of Examples 1 to 7, of which the difference (X–Y) of a deformation amount Y and a secondary natural frequency X of the golf ball is within the range of 0.1 to 1.5, have longer flight distance, smaller impact force and better shot feel.

On the other hand, the hollow golf balls of Comparative Examples 1 and 5 having smaller (X–Y) value have good shot feel, but have short flight distance. The hollow golf ball of Comparative Example 2 having larger (X–Y) value has long flight distance, but has poor shot feel. The solid golf balls of Comparative Examples 3 and 4 have poorer shot feel than the golf balls of the present invention because they have not a hollow portion. Particularly, the golf ball of Comparative Example 3 has poorer shot feel in spite of having (X–Y) value of 0.1 to 1.5. The hollow golf balls of Examples 1 and 4, and Comparative Example 5 have approximately same level of deformation amount (3.2 to 3.3 mm), but have very different value of flight distance and coefficient of restitution.

What is claimed is:

1. A hollow golf ball comprising:

a hollow core composed of a hollow portion and at least one hollow core outer layer defining the hollow portion and formed from a composition comprising a rubber component, a resin component or mixtures thereof, and a cover formed on the hollow core outer layer, wherein, when a secondary natural frequency of the hollow golf ball is expressed as X (kHz) and a deformation amount, when applying from an initial load of 10 kgf to a final load of 130 kgf on the hollow golf ball, is expressed as Y (mm), the difference of X–Y is within the range of 0.1 to 1.5.

2. The hollow golf ball according to claim 1, wherein the hollow portion has a diameter of 5 to 25 mm.

3. The hollow golf ball according to claim 1, wherein the secondary natural frequency X is within the range of 2 to 5 kHz, and the deformation amount Y is within the range of 2.0 to 4.0 mm.

4. The hollow golf ball according to claim 2, the secondary natural frequency X is within the range of 2 to 5 kHz, and the deformation amount Y is within the range of 2.0 to 4.0 mm.

5. The hollow golf ball of claim 1, wherein the hollow core outer olayer is formed of a rubber composition comprising a base rubber, a metal salt of an unsaturated carboxylic acid, an organic peroxide and a filler.

6. The hollow golf ball of claim 5, wherein the base rubber is a natural or synthetic rubber.

7. The hollow golf ball of claim 6, wherein the synthetic rubber is high cis-polybutadiene rubber having a cis band of not less than 40%.

8. The hollow golf ball of claim 5, wherein the hollow core outer layer is a multi-layer structure of at least two layers wherein at least the external layer is formed from the rubber composition.

9. The hollow golf ball of claim 6, wherein the synthetic resin has a Shore D hardness of 30–80.

10. The hollow golf ball of claim 1, wherein the internal pressure in the hollow portion is atmospheric pressure ±40%.

11. A hollow golf ball consisting essentially of:

a hollow core composed of a hollow portion and at least one hollow core outer layer defining the hollow portion and formed from a composition comprising a rubber component, a resin component or mixtures thereof, and a cover formed on the hollow core outer layer, wherein, when a secondary natural frequency of the hollow golf ball is expressed as X (kHz) and a deformation amount, when applying from an initial load of 10 kgf to a final load of 130 kgf on the hollow golf ball, is expressed as Y (mm), the difference of X–Y is within the range of 0.1 to 1.5.

12. A method of making the hollow golf ball of claim 1, comprising the steps of:

forming a hollow core with a hollow core outer layer composition comprising a rubber component, a resin component or mixtures thereof; and covering said hollow core outer layer with a cover to form a hollow golf ball, wherein the hollow core, hollow core outer layer composition, cover composition and conditions for forming the hollow core, hollow core outer layer and cover are selected to achieve a secondary natural frequency of the hollow golf ball expressed as X (kHz) and a deformation amount, when applying from an initial load of 10 kgf to a final load of 130 kgf on the hollow golf ball, expressed as Y (mm), the difference of X–Y is within the range of 0.1 to 1.5.

* * * * *